US009266211B2

(12) United States Patent
Yoshihara et al.

(10) Patent No.: US 9,266,211 B2
(45) Date of Patent: Feb. 23, 2016

(54) METHOD AND APPARATUS FOR SMOOTHING WELDED MEMBER

(71) Applicant: SHIROKI CORPORATION, Fujisawa-shi, Kanagawa (JP)

(72) Inventors: Jiro Yoshihara, Fujisawa (JP); Isami Mituhashi, Fujisawa (JP); Kazuhisa Shirai, Fujisawa (JP)

(73) Assignee: SHIROKI CORPORATION, Fujisawa-Shi (JP)

( * ) Notice: Subject to any disclaimer, the term of this patent is extended or adjusted under 35 U.S.C. 154(b) by 0 days.

(21) Appl. No.: 14/403,300

(22) PCT Filed: May 22, 2013

(86) PCT No.: PCT/JP2013/064255

§ 371 (c)(1),
(2) Date: Nov. 24, 2014

(87) PCT Pub. No.: WO2013/176187

PCT Pub. Date: Nov. 28, 2013

(65) Prior Publication Data

US 2015/0111471 A1 Apr. 23, 2015

(30) Foreign Application Priority Data

May 25, 2012 (JP) ..... 2012-119237

(51) Int. Cl.
*B24B 21/16* (2006.01)
*B24B 21/08* (2006.01)
*B24B 9/04* (2006.01)

(52) U.S. Cl.
CPC . *B24B 21/16* (2013.01); *B24B 9/04* (2013.01); *B24B 21/08* (2013.01)

(58) Field of Classification Search
CPC ..... B24B 49/16; B24B 49/04; B24B 21/16; B24B 21/08; B24B 37/013; B24B 37/04; B24B 47/22
USPC ..... 451/5, 6, 8–11, 303
See application file for complete search history.

(56) References Cited

U.S. PATENT DOCUMENTS 3,429,079 A * 2/1969 Winebarger ..... B24B 21/08 451/303
4,084,356 A * 4/1978 Brears ..... B24B 21/08 144/355

(Continued)

FOREIGN PATENT DOCUMENTS

JP 58-109263 A 6/1983
JP 2-89001 U 7/1990

(Continued)

OTHER PUBLICATIONS

International Search Report dated Sep. 3, 2013 issued in corresponding PCT/JP2013/064255 application (pp. 1-2).

(Continued)

*Primary Examiner* — George Nguyen
(74) *Attorney, Agent, or Firm* — Millen, White, Zelano & Branigan, P.C.

(57) ABSTRACT

A smoothing method and a smoothing apparatus has been achieved, which make it possible to automate smoothing of welded members that was formerly carried out manually.
The method according to the present invention uses a belt grinding apparatus, which includes an endless grinding belt and a press pad that presses the grinding belt against a welded area, and uses this belt grinding apparatus in two different modes after obtaining information on heights of surfaces of two welded members along a weld bead of the two welded members. The first mode corresponds to a bead removing step in which the grinding belt is pressed against a welded area by the press pad to reduce the height of the weld bead. At this time, the grinding belt is made to run at a fixed position, while the press pad is made to move toward and away from the welded area (the surface thereof). The next mode corresponds to a smoothing step in which the grinding belt is made to run and pressed against the welded area by the press pad while being made to move along the surfaces of the two welded members to smooth the welded area.

18 Claims, 11 Drawing Sheets

(56) References Cited

U.S. PATENT DOCUMENTS

| | | | | | |
|---|---|---|---|---|---|
| 4,219,720 | A * | 8/1980 | Moench | B23K 15/02 | 219/121.12 |
| 4,353,236 | A * | 10/1982 | Byrd | B21C 37/0811 | 228/125 |
| 4,602,732 | A * | 7/1986 | Schaeffer | A47J 31/542 | 228/125 |
| 4,816,639 | A * | 3/1989 | Sugitani | B23K 9/0956 | 219/130.21 |
| 5,303,514 | A | 4/1994 | Oishibashi et al. | | |
| 5,386,665 | A * | 2/1995 | Heim | B24B 7/30 | 451/304 |
| 8,771,037 | B2 * | 7/2014 | Boggs | B24B 21/006 | 451/11 |
| 2002/0155790 | A1 * | 10/2002 | Ido | G05B 19/401 | 451/9 |
| 2009/0011691 | A1 | 1/2009 | L'Helgoualc'H et al. | | |
| 2015/0111471 | A1 * | 4/2015 | Yoshihara | B24B 21/08 | 451/5 |

FOREIGN PATENT DOCUMENTS

| | | | |
|---|---|---|---|
| JP | 6-759 | A | 1/1994 |
| JP | 6-759 | * | 11/1994 |
| JP | 2000-52211 | A | 2/2000 |
| JP | 2000-61778 | A | 2/2000 |
| JP | 2000-288789 | * | 10/2000 |
| JP | 2000-288789 | A | 10/2000 |
| JP | 2006-198710 | A | 8/2006 |
| JP | 2008-173762 | A | 7/2008 |
| JP | 2012-1153 | A | 1/2012 |

OTHER PUBLICATIONS

English Translation Abstract of JP 58-109263 published Jun. 29, 1983.
English Translation Abstract of JP H 02-89001 published Jul. 13, 1990.
English Translation Abstract of JP 06-000759 published Jan. 11, 1994.
English Translation Abstract of JP 2000-052211 published Feb. 22, 2000.
English Translation Abstract of JP 2000-061778 published Feb. 29, 2000.
English Translation Abstract of JP 2000-288789 published Oct. 17, 2000.
English Translation Abstract of JP 2006-198710 published Aug. 3, 2006.
English Translation Abstract of JP 2008-173762 published Jul. 31, 2008.
English Translation Abstract of JP 2012-001153 published Jan. 5, 2012.

* cited by examiner

METHOD AND APPARATUS FOR SMOOTHING WELDED MEMBER

TECHNICAL FIELD

The present invention relates to a method and an apparatus for smoothing a welded area between welded members.

BACKGROUND ART

For instance, a vehicle door frame is formed by butt-welding (corner-welding) a pillar member (upright pillar sash, door frame member) and a sash member (upper sash member, door frame member). In this welding process, TIG (Tungsten Inert Gas) welding or MIG (Metal Inert Gas) welding is generally used.

In this door frame member welding process, the occurrence of a weld bead (protrusion) at the welding area cannot be avoided. This weld bead appears on design surfaces of the pillar member and the sash member, thus being absolutely necessary to be grounded away to produce a smooth surface, and the weld bead was formerly removed manually by a worker. In addition to a roll-forming product of a metallic material, an extrusion-molded product of an aluminum alloy is also used as a door frame material for the purpose of weight reduction.

CITATION LIST

Patent Literature

Patent Literature 1: Japanese Unexamined Patent Publication No. 2000-52211

Patent Literature 2: Japanese Unexamined Patent Publication No. 2012-001153

Patent Literature 3: Japanese Unexamined Patent Publication JPS58-109263

SUMMARY OF INVENTION

Technical Problem

An object of the present invention is to obtain a smoothing method and a smoothing apparatus which enables an automated smoothing operation to be carried out on a welded member(s) that was formerly performed manually. In addition, an object of the present invention is to obtain a smoothing method and a smoothing apparatus which make it possible to perform a smoothing operation on a weld bead within takt (cycle) time, having a predetermined period of time (range).

Solution to Problem

The present invention has been devised while focusing attention on performing a smoothing operation on a welded area after first removing a weld bead (reducing in height), focusing attention on using height information of the surrounding area of the welded area when removing the weld bead, and focusing attention on using the same belt grinding apparatus, which includes an endless grinding belt and a press pad which presses the grinding belt against a welded area, for weld bead removal and for the smoothing operation.

The present invention is based on the premise that a belt grinding apparatus is used, which includes an endless grinding belt and a press pad which presses the grinding belt against a welded area. This type of belt grinding apparatus has been made known by, e.g., Patent Literature 3. Additionally, in the method according to the present invention, information on the heights of surfaces of two welded members along the weld bead is obtained, and thereafter this belt grinding apparatus is used in two different modes. The first mode corresponds to a bead removing step at which the grinding belt is pressed against a welded area by the press pad to reduce the height of the weld bead. At this time, the grinding belt is made to run at a fixed position, while the press pad is made to move toward and away from the welded area (the surface thereof). The next mode corresponds to a smoothing step at which the grinding belt is made to run and pressed against the welded area by the press pad while being made to move along the surface of the two welded members to smooth the welded area.

Namely, according to the present invention, to perform the first step of reducing the height of the weld bead, information on the heights of the butt end surfaces of two welded members along the weld bead is detected, and the amount of lowering (projecting) of the grinding belt toward the weld bead is determined so that the weld bead is removed even at the lowest part thereof.

The method of smoothing a welded area according to the present invention is a method of removing a weld bead between two welded members to smooth the welded area and is characterized by including a step of preparing a belt grinding apparatus, which includes an endless grinding belt and a press pad that presses the grinding belt against the welded area; a measuring step for detecting positions of heights of surfaces of the two welded members along the weld bead; a bead removing step for reducing a height of the weld bead by pressing the grinding belt against the welded area via the press pad while running the grinding belt using information on the positions of the heights of the surfaces of the two welded members that are detected in the measuring step; and a smoothing step for smoothing the welded area by pressing the grinding belt against the welded area via the press pad while running the grinding belt and moving the grinding belt along the surfaces of the two welded members.

It is desirable for information on heights of a plurality of points along both sides of the weld bead to be obtained in the measuring step.

It is desirable for the welded area smoothing method to include a step of detecting an angular difference between the surfaces of the two welded members in a direction orthogonal to the weld bead and a in direction along the weld bead; and a step of adjusting angles of the grinding belt and the press pad relative to the surfaces of the two welded members based on the angular difference that is detected in the angular difference detecting step.

It is desirable for the two welded members to each include a plane portion which extends leftward and rightward from an end of the weld bead in a direction of extension thereof, and for the method to further include a step of grinding and removing a projecting weld bead which projects from the plane portion using the grinding belt and the press pad.

It is desirable for the two welded members to be uneven members, one end part of which is lower in a direction of formation of the weld bead, and for the bead removing step and the smoothing step to be performed by lifting a lower part of the two welded members.

It is desirable for a hardness of the press pad used in the bead removing step to be greater than a hardness of the press pad used in the smoothing step.

It is desirable for a width of the grinding belt and a planar size of the press pad to be each set to a size to cover the length of the weld bead.

In the bead removing step, it is desirable for at least one of the following grinding conditions to be determined so that the weld bead is removed within a fixed time period: a running speed and a tension of the grinding belt, and a projecting amount and a projecting force of the press pad.

The two welded members can be, for example, a pillar member and a frame member of a door frame.

It is further desirable for the method according to the present invention to include performing a joint removing process step using a polisher on surfaces of the two welded members, from which the weld bead has been removed, after the weld bead removing step and the smoothing step has been performed using the grinding belt.

In the method according to the present invention, it is further desirable to include a step of detecting an angular difference between the surfaces of the two welded members in a direction orthogonal to the weld bead and in a direction along the weld bead, and a step of adjusting an angle of the polisher based on the angular difference that is detected in the angular difference detecting step.

In another embodiment of the present invention, a welded area smoothing apparatus for removing and smoothing a weld bead of two welded members is provided, including a belt grinding apparatus which includes an endless grinding belt that is driven to run and a press pad that presses the grinding belt against the welded area; a jig for setting the two welded members which include the weld bead; a measuring apparatus which measures positions of heights of surfaces of the two welded members, which are set by the jig, along the weld bead; a position controller which moves the belt grinding apparatus relative to the jig; and a controller which controls the belt grinding apparatus, the measuring apparatus and the position controller. The controller reduces a height of the weld bead by pressing the grinding belt against the welded area via the press pad while running the grinding belt using information on the positions of the heights of the surfaces of the two welded members that are detected by the measuring apparatus, and subsequently, the controller smoothes the welded area by pressing the grinding belt against the welded area via the press pad while running the grinding belt and moving the grinding belt along the surfaces of the two welded members.

In the welded area smoothing apparatus of the present invention, it is desirable for the measuring apparatus to detect an angular difference between the surfaces of the two welded members in a direction orthogonal to the weld bead and in a direction along the weld bead, and for the controller to adjust angles of the grinding belt and the press pad relative to the surfaces of the two welded members based on the angular difference.

Furthermore, it is desirable for the two welded members to include a plane portion which extends leftward and rightward from an end of the weld bead in a direction of extension thereof, and for the controller to grind and remove a projecting weld bead which projects from the plane portion using the grinding belt and the press pad.

It is desirable for the two welded members to be an uneven member, one end of which in a direction of formation of the weld bead is low, and for the jig to include a partial floatation apparatus which lifts a lower part of the two welded members.

It is desirable for the belt grinding apparatus to include a press pad mechanism which switches the press pad to be used for another press pad during the removing and smoothing of the weld bead.

In the welded area smoothing apparatus according to the present invention, it is desirable for, in addition to the belt grinding apparatus, a polisher to be further used to perform a joint removing process on surfaces of the two welded members from which the weld bead is removed.

It is desirable for the polisher to be able to adjust an angle thereof based on an angular difference between the surfaces of the two welded members in a direction orthogonal to the weld bead and in a direction along the weld bead.

Advantageous Effects of Invention

According to the present invention, a belt grinding apparatus which includes an endless grinding belt and a press pad that presses the grinding belt against a welded area is used, the height of the weld bead is reduced by pressing the grinding belt against a welded area via the press pad while making the grinding belt run at the first step, and the welded area is smoothed by pressing the grinding belt against the welded area via the press pad while making the grinding belt run and moving the grinding belt along the surfaces of the two welded members at the second step, and accordingly, the weld bead can be easily removed to smooth the welded area. In addition, the time required to perform the first step and the second step can be controlled, which enables the takt time required for the smoothing operation to become substantially constant and facilitates the automation of the smoothing process.

BRIEF DESCRIPTION OF DRAWINGS

FIG. 14 is a conceptual diagram showing a corner rounding process of an outline polishing process using the polisher.

DESCRIPTION OF EMBODIMENTS

Figure 1:
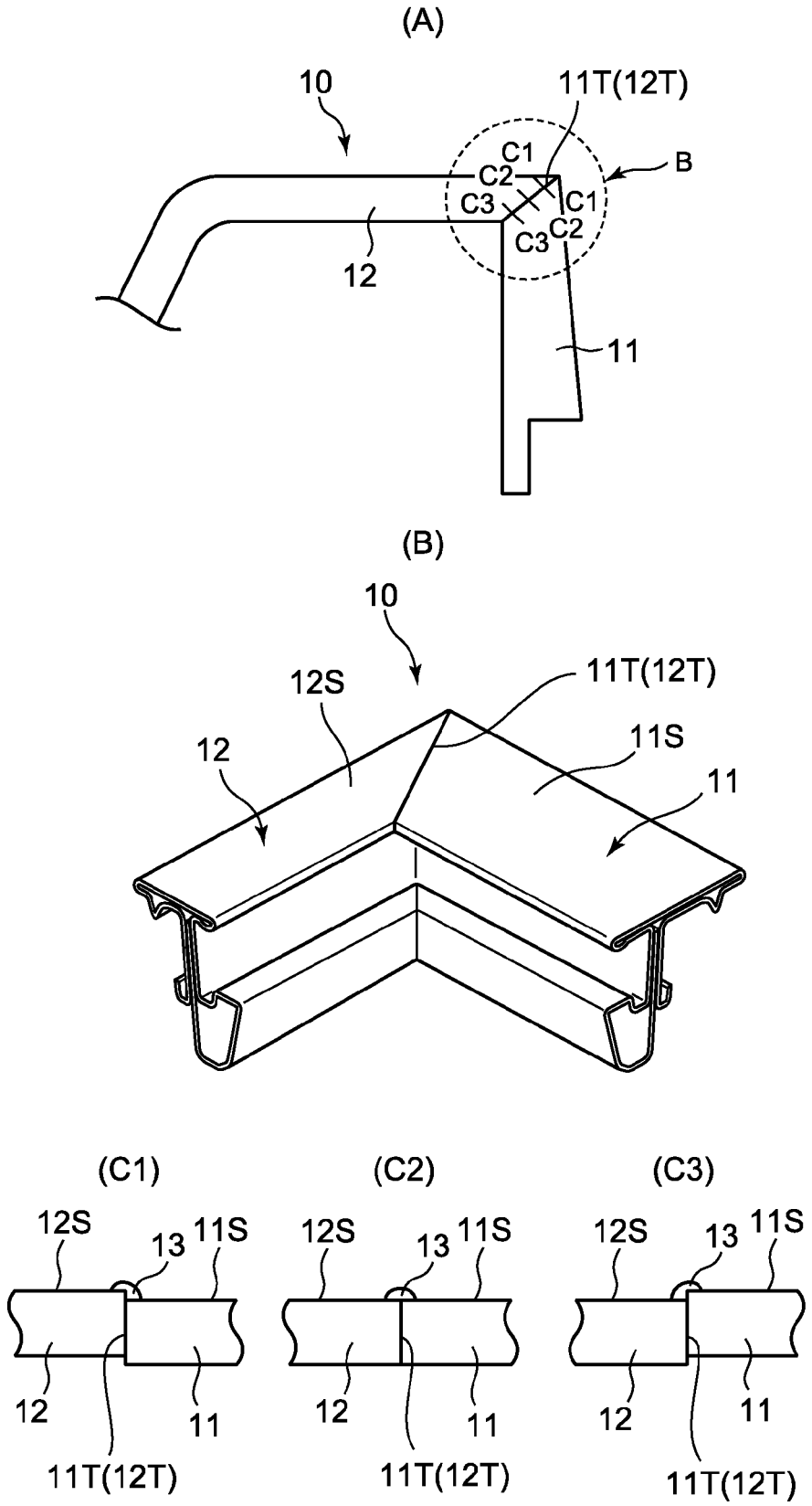
FIG. 1(A) is a plan view of a vehicle door frame to which a method of smoothing a welded area according to the present invention is applied.
FIG. 1(B) is a perspective view of part B shown in FIG. 1(A), and FIGS. 1(C1), 1(C2) and 1(C3) are cross sectional views taken along the lines C1-C1, C2-C2 and C3-C3 shown in FIG. 1(A), respectively.

FIG. 1 shows a door frame 10 which includes of a pillar member (front pillar, upright pillar sash, first door frame member) 11 and a frame member (upper sash, second door frame member) 12, serving as two welded members to which a method of smoothing a welded area according to the present invention is applied. The pillar member 11 and the frame member 12 are each formed of a roll-formed product made of a ferrous material, and a butt-welding edge 11T of the pillar member 11 and a butt-welding edge 12T of the frame member 12 are butt-welded (corner-welded), and a weld bead 13 formed on the welding area protrudes and bulges from a surface 11S of the pillar member 11 and a surface 12S of the frame member 12.

Figure 2:
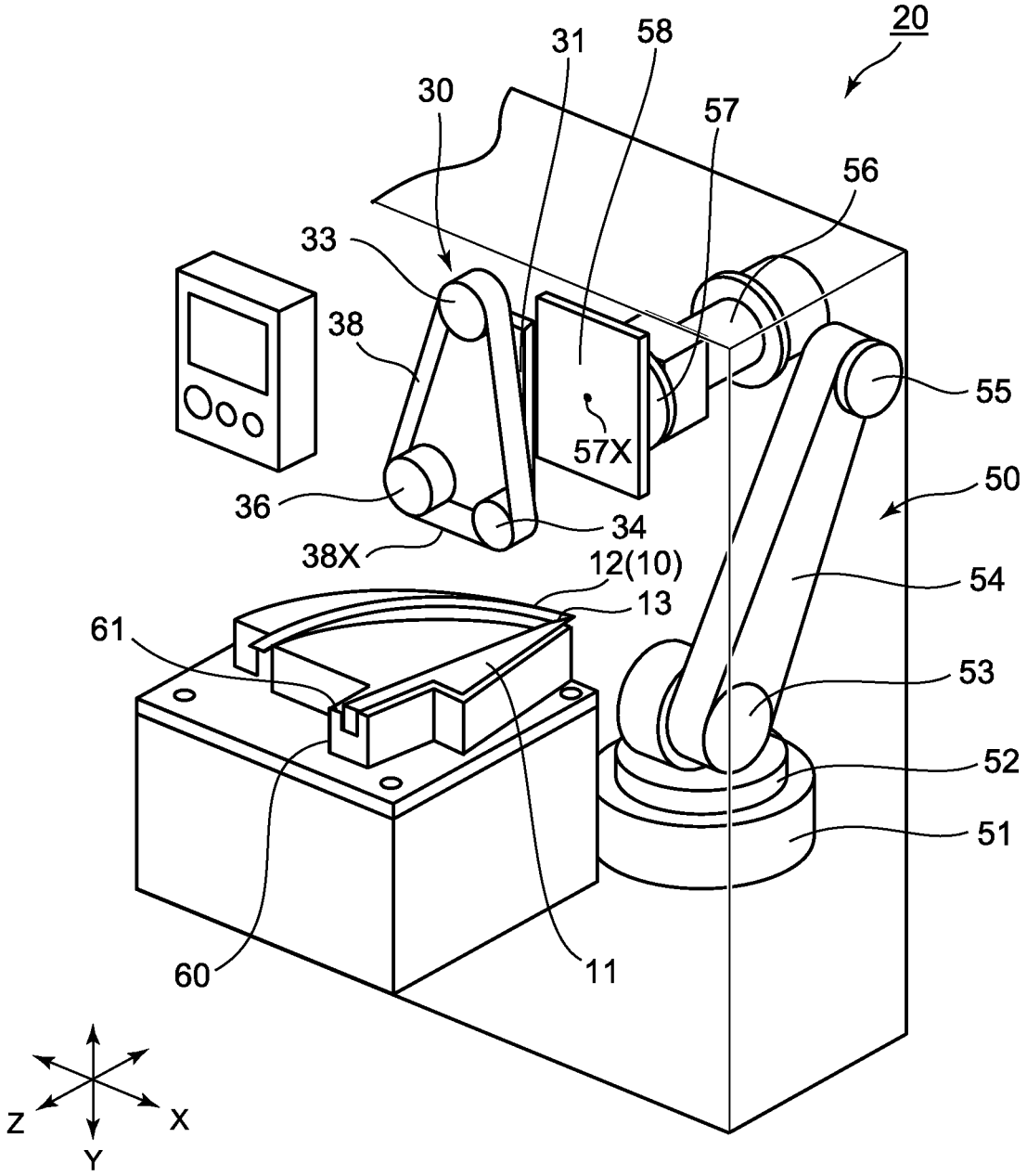
FIG. 2 is a perspective view of an embodiment of an apparatus which performs the smoothing method according to the present invention.
Figure 3:
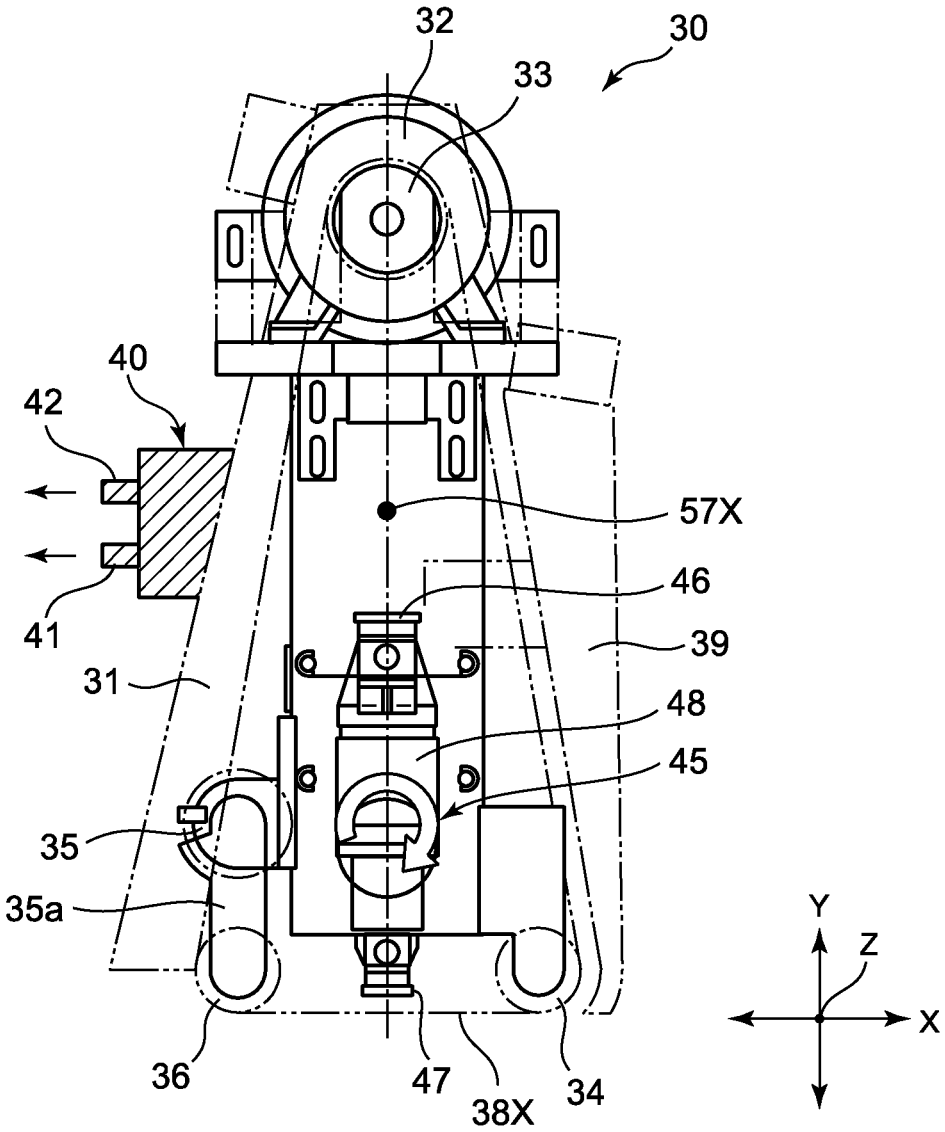
FIG. 3 is a front elevational view of a belt grinding apparatus within the apparatus shown in FIG. 2.

FIG. 2 shows a smoothing apparatus 20 for smoothing a welded area which practices the method according to the present invention, and FIG. 3 shows a belt grinding apparatus 30 in the smoothing apparatus 20. The smoothing apparatus 20 is provided with the belt grinding apparatus 30, a position controller (position control robot) 50 for the belt grinding apparatus 30 and a jig 60 for setting the post-weld door frame 10. In addition, a laser length-measuring apparatus 40, serving as a measuring apparatus, which measures the surface heights (Y-coordinates) of the surface 11S of the pillar member 11 and the surface 12S of the frame member S12 is fixed to a support base 31 of the belt grinding apparatus 30.

The belt grinding apparatus 30 is supported on the support base 31, and the position of which is controlled by the position controller 50; the basic configuration of the belt grinding apparatus 30 is disclosed in Patent Literature 3. As shown in FIG. 3, the belt grinding apparatus 30 is provided with three pulleys: a drive pulley 33 which is driven to rotate at a fixed position by a drive motor 32, a guide pulley 34 which is rotatably supported at a fixed position, and a tension pulley 36 which is rotatably supported at the end of a swing arm 35*a* of an air swing actuator 35, and an endless grinding belt (sanding belt) 38 is wound around the peripheries of the drive pulley 33, the guide pulley 34 and the tension pulley 36. Driving the drive motor 32 to rotate drive pulley 33 causes the endless grinding belt 38 to run, and tension on the endless grinding belt 38 varies by changing the swing position of the swing arm 35*a* of the air swing actuator 35. The running speed of the endless grinding belt 38 can be freely set by the drive motor 32, and the grinding load can be detected via the drive motor 32. In the present embodiment, a workpiece to be ground (the weld bead 13 of the door frame 10 (and welded areas on the left and right sides thereof)) is ground by a work section belt 38X (grinding section) positioned between the guide pulley 34 and the tension pulley 36. During this grinding process, the work section belt 38X of the belt grinding apparatus 30 is positioned above the jig 60 (the door frame 10 set to the jig 60). In addition, a dust collector hopper 39 is disposed on the outer side of the grinding belt 38 of the drive pulley 33 and the guide pulley 34.

A press pad mechanism 45 which is supported by the support base 31 is positioned in a space surrounded by the grinding belt 38. The press pad mechanism 45 is provided with a pair of (plurality of) press pads 46 and 47 and a rotational actuator 48 which selectively positions the press pad 46 and the press pad 47 on the inner side of the grinding belt 38. The pressing force of each press pad 46 and 47 against the work section belt 38X (the amount of projection of each press pad 46 and 47 toward the work section belt 38X) can be adjusted by an air actuator. The press pad 46 can be, e.g., a hard press pad for rough grinding, and the press pad 47 can be, e.g., a soft press pad for fine grinding (for polishing).

The jig 60 is for holding the surface 11S of the pillar member 11 and the surface 12S of the frame member 12 so that the surface 11S and the surface 12S become substantially parallel to the work section belt 38X, and is provided with a work accommodating portion 61 which accommodates the door frame 10. The term. "substantially parallel" means to hold the door frame 10 so that, when the outer sides of the surfaces 11S and the 12S are regarded as a plane (flat surface), this imaginary plane of the outer sides of the surfaces 11S and the 12S and the work section belt 38X become parallel to each other because the surface 11S of the pillar member 11 and the surface 12S of the frame member 12 are not perfectly flat and have a descending gentle curved surface on the inner side (on the window opening side). If the surfaces of the two welded members form a flat surface, the door frame 10 is set on the jig 60 so that this flat surface and the work section belt 38X become parallel to each other.

Figure 5:
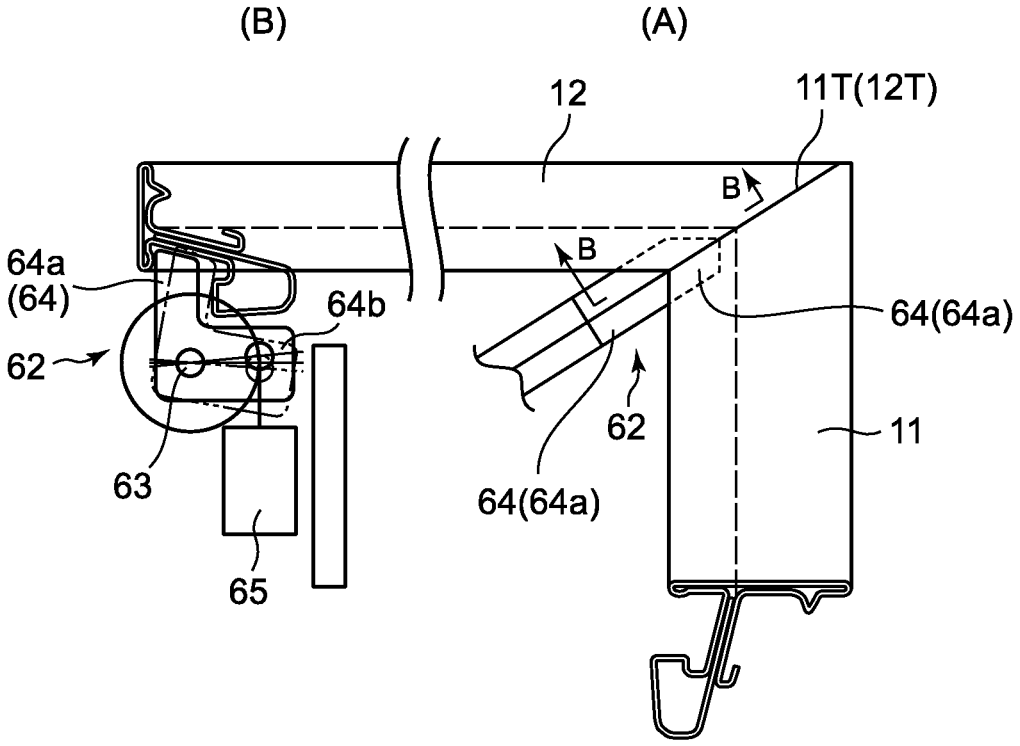
FIG. 5(A) is a plan view of a partial floatation apparatus which is provided in a tool in the apparatus shown in FIG. 2.
FIG. 5(B) is a cross sectional view taken along the line B-B shown in FIG. 5(A)

As shown in FIG. 5, the jig 60 is provided with a partial floatation apparatus 62 which deforms the descending curved surface on the inner side of the pillar member 11 and the frame member 12 upward for grinding. The partial floatation apparatus 62 is provided with a lifting crank 64 which is rotatable about a shaft 63. The lifting crank 64 is provided at one end thereof with a lifting arm 64*a* which is positioned to extend over the lower surfaces (bottom surfaces) of the butt-welding edge 11T of the pillar member 11 and the butt-welding edge 12T of the frame member 12, and an air actuator 65 is connected to a drive arm 64*b*, which is provided at the other end of the lifting crank 64. Thrusting out the drive arm 64*b* using the air actuator 65 causes the lifting arm 64*a* to lift portions of the pillar member 11 and the frame member 12 in the close vicinity of the butt-welding edge 11T and the butt-welding edge 12T so as to bring these portions closer to a single plane.

The position controller 50 is a known apparatus for freely controlling the position of the belt grinding apparatus 30 (the support base 31) relative to the jig 60 and is provided, on a body base 51 fixed to a floor, with a rotatable base 52 rotatable about a perpendicular axis, and the lower end of a first arm 54 is supported by the rotatable base 52 to be swingable about a horizontal shaft 53. An extendable second arm 56 is pivoted at the upper end of the first arm 54 via a horizontal shaft 55, a rotatable base 57 rotatable about a rotational shaft 57X is mounted onto the end of the second arm 56, and a support head plate 58 is mounted onto the rotatable base 57. The position controller 50 can move the support head plate 58 toward any given position and direction and can control the position thereof by rotational movement of the rotatable base 52 about the perpendicular axis, rotational movement of the first arm 54 about the shafts 53 and 55, expanding, contracting movement of the second arm 56, and rotational movement of the rotatable base 57 about the rotational shaft 57X.

The support head plate 58 is connected to the support base 31 of the belt grinding apparatus 30, so that the position controller 50 can freely control the position of the belt grinding apparatus 30. The support base 31 can rotate (swing) about the rotational shaft 57X (see FIGS. 3 and 4) of the rotatable base 57 (can change in direction at least between the two positions shown in FIGS. 3 and 4), and in this embodiment the laser length-measuring apparatus 40, which measures the heights of the surface 11S of the pillar member 11 and the surface 12S of the frame member S12, is supported by the support base 31 using the rotating capability of the rotatable base 57. Namely, the support base 31 can change the orientation thereof between a grinding position shown in FIG. 3, in which the work section belt 38X of the belt grinding apparatus 30 faces horizontally, and a measuring position shown in FIG. 4, in which the work section belt 38X of the belt grinding apparatus 30 faces vertically; the position controller 50 includes this base direction (orientation) converting apparatus 31T (see FIG. 8). The laser length-measuring apparatus 40 that is fixed to the support base 31 is provided with two laser length-measuring devices 41 and 42, and the laser length-measuring devices 41 and 42 face the surface 11S of the pillar member 11 and the surface 12S of the pillar member 12, respectively. The laser length-measuring (distance measuring) devices 41 and 42 are known in the art, in which the laser light emitted from a laser source is split into a measuring light and a reference light by a beam splitter, the measuring light is projected toward the surfaces 11S and 12S, and light reflected thereby is detected by a photodetector on one hand, whereas the reference light reflected at a fixed position is made incident on the same photodetector to detect a phase difference between the measuring light and the reference light, and the distance from the reference position of the laser length-measuring device 41 to the surface 11S and the distance from the reference position of the laser length-measuring device 42 to the surface 12S are measured based on the phase difference thus detected.

The position controller 50 is provided with a coordinate detection system which detects the coordinates of the rotational shaft 57X of the rotatable base 57 in the vertical direction (X-direction), the lateral direction (Y-direction), and the Z-direction which orthogonal to the X-direction and the Y-direction, and a rotational position detection system (90-degree coordinate conversion system) which detects the rotational position of the support base 31, and is further provided with a detection system which detects the distances from the rotational shaft 57X to the laser length-measuring devices 41 and 42, the distance from the rotational shaft 57X to the work section belt 38X and the distances from the rotational shaft 57X to the ends of the press pad 46 and the fine-grinding press pad 47 of the press pad mechanism 45. Accordingly, the positions of the surface 11S of the pillar member 11 and the surface 12S of the frame member 12, the position of the rotational shaft 57X in the X, Y and Z directions, the position of the work section belt 38X of the belt grinding apparatus 30 in the X, Y and Z directions, and the positions of the press pad 46 and the fine-grinding press pad 47 of the press pad mechanism 45 in the X, Y and Z directions are correctly detected.

In the present embodiment, the weld bead 13 of the door frame 10 is removed and smoothed using the smoothing apparatus 20, which includes the belt grinding apparatus 30 (and the laser length-measuring unit 40) and the position controller 50, in a manner will be discussed hereinafter.

Measuring Step

Figure 4:
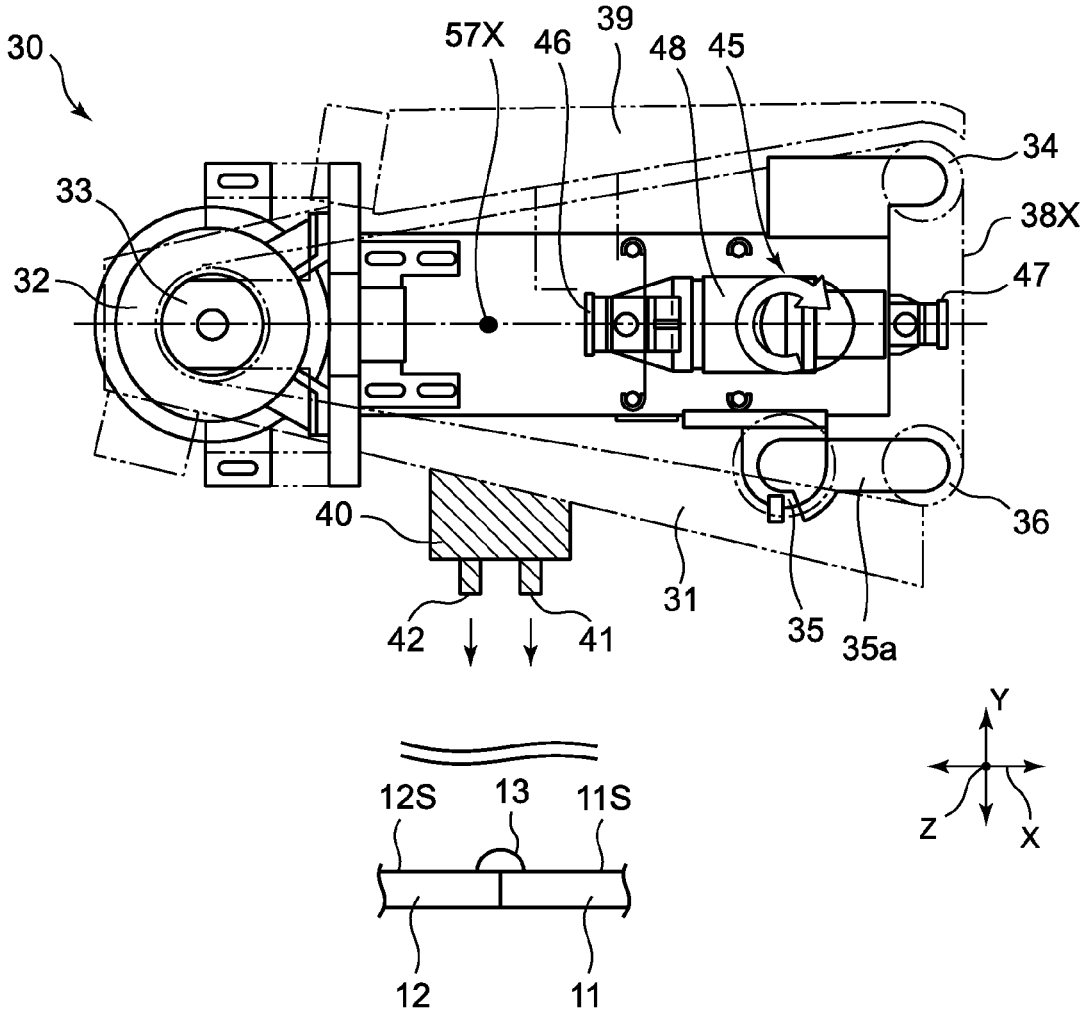
FIG. 4 is a front elevational view when a support base of the belt grinding apparatus shown in FIG. 3 has been rotated by 90 degrees about the rotational shaft of a rotating platform to put the apparatus into a height position detection mode, in which the positions of the heights of surfaces of two welded members are detected.
Figure 6:
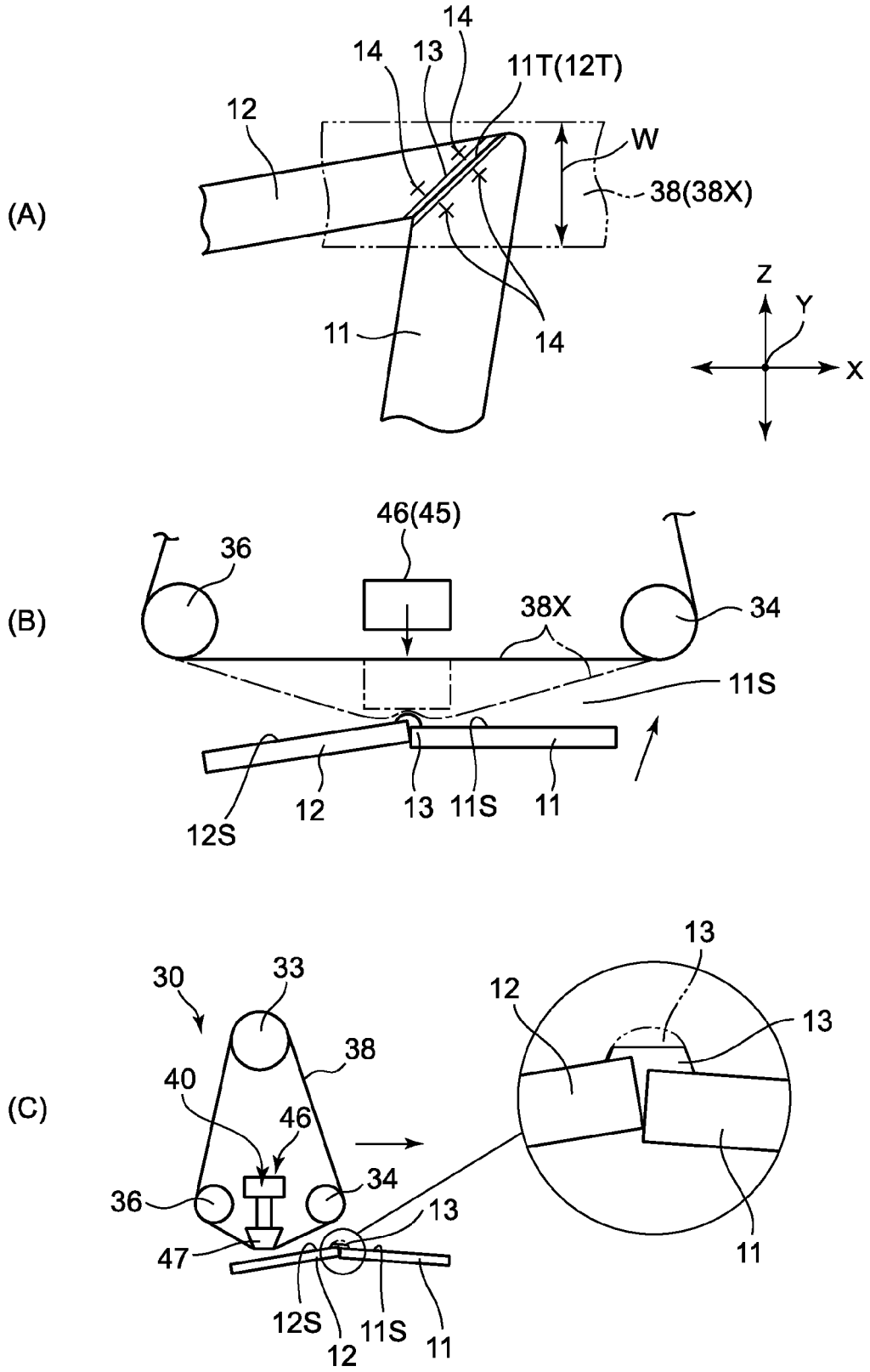
FIGS. 6(A), 6(B) and 6(C) show steps of the smoothing method according to the present invention.

In the first step, the door frame 10 is accommodated (set) in the work accommodating portion 61 of the jig 60, and in this state the belt grinding apparatus 30 (the support base 31) is rotated about the rotational shaft 57X by 90 degrees using the position controller 50 (the base direction (orientation) changing apparatus 31T), and the direction of emission of the measuring light from each laser length-measuring device 41 and 42 is directed to travel in the X-direction as shown in FIG. 4. Subsequently, the height of the butt-welding edge 11T of the pillar member 11 along the weld bead 13 and the height of the butt-welding edge 12T along the weld bead 13 (these heights (Y-coordinates) are of portions which are as close to the weld bead 13 as possible and do not include the weld bead 13) are detected by the laser length-measuring devices 41 and 42. As exaggeratedly shown in FIGS. 1(C1), 1(C2) and 1(C3), the height (Y-coordinate) of the butt-welding edge 11T of the pillar member 11 along the weld bead 13 and the height (Y-coordinate) of the butt-welding edge 12T along the weld bead 13 vary. Note that the actual heights (Y-coordinates) of the surface 11S and the surface 12S are in the order of micrometers. The reference numeral 14 in FIG. 6(A) show four measuring points. Movements of the laser length-measuring devices 41 and 42 in the Z-direction (and the X-direction) are performed by the position controller 50.

Measurement of the heights (Y-coordinates) of the surface 11S and the surface 12S can be carried out by a contact sensor(s); moreover, a height map can be created by scanning areas of the surfaces 11S and 12S around the periphery of the weld bead 13. In this measurement step, the lowest height (Y-coordinate) among the heights (Y-coordinates) of the surfaces 11S and 12S along the weld bead 13 is detected. At this time, the maximum height (Y-coordinate) of the weld bead 13 can be detected.

Weld Bead Removing (Height Reducing) Step (Rough Grinding Process)

The second step is for removing the weld bead 13. In this step, using the position controller 50 (the base direction (orientation) converting apparatus 31T), the belt grinding apparatus 30 (the support base 31) is rotated about a rotational shaft 57X by 90 degrees, and the work section belt 38X of the belt grinding apparatus 30 is directed to travel in the X-direction, as shown in FIG. 3. In this weld bead removal operation, with the belt grinding apparatus 30 lowered to a fixed position and held thereat by the position controller 50 and with the work section belt 38X held to be parallel to the surface 11S of the door frame 10 and the surface 12S of the frame member 12, the press pad 46 of the press pad mechanism 45 is made to project toward the weld bead 13 to bring the running grinding belt 38 into contact with the weld bead 13 to grind and remove the weld bead 13 (to reduce the height of the weld bead 13). The grinding belt 38 has a sufficient width to remove the entire weld bead 13 at once, which is formed between the butt-welding edge 11T and the butt-welding edge 12T (the surface 11S and the surface 12S). Namely, as shown in FIG. 6(A), the width W of the grinding belt 38 in the Z-direction is set to be greater than the length w of the weld bead 13 in the Z-direction. The widths (diameters) of the press pads 46 and 47 in the Z-direction are also greater than the length w of the weld bead in the Z-direction. Namely, the width of the grinding belt 38 and the planar size of the press pad 46 are each set to a size to cover the length of the weld bead 13 at all times, with consideration of the direction of the weld bead 13. At this weld bead removing step, the amount of projection of the rough-grinding press pad 46 in the Y-direction is determined from information (Y-coordinate) on the lowest height of the surface of the door frame 10 at the first step.

Figure 7:
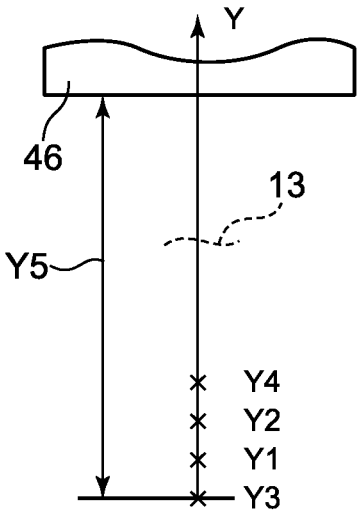
FIG. 7 is a schematic diagram of an example of the height coordinates of two welded members along a weld bead and the projecting position of a press pad.

FIG. 7 schematically illustrates four measuring points (Y-coordinates) Y1, Y2, Y3 and Y4 on the surface of the door frame 10 and the amount of projection (fully projected position) of the rough-grinding press pad 46 from an initial position thereof in the Y-direction, and an amount of projection Y5 of the press pad 46 is set so that the rough-grinding press pad 46 reaches the lowest measuring point (surface) Y3 of the four measuring points.

In order for this weld bead removing step to be performed within a fixed period of time (takt time; e.g., three seconds), grinding conditions including the running speed of the grinding belt 38 by the drive motor 32, the tension of the grinding belt 38 by the air swing actuator 35 and the pressure of the projecting rough-grinding press pad 46 by an air actuator are determined using the aforementioned lowest height (Y-coordinate) of the door frame 10. For instance, the commencement of contact of the work section belt 38X with the weld bead 13 (the Y-coordinate of the weld bead 13) can be detected from loads exerted on the drive motor 32, and accordingly, the time from this point to the moment the work section belt 38X reaches the lowest height (Y-coordinate) of the surface of the door frame 10 (the weld bead removal completion time) is determined to determine the aforementioned grinding conditions. When the height (Y-coordinate) of the weld bead 13 at the measuring step is measured, information on this height can be used to determine the grinding conditions.

Welded Area Smoothing Step (Fine Grinding Step)

In the third step, the rough-grinding press pad 46 is switched to the fine-grinding press pad 47 by the rotational actuator 48 of the press pad mechanism 45. Subsequently, the surface 11S of the butt-welding edge 11T and the surface 12S of the butt-welding edge 12T that include the removed trace of the weld bead 13 are smoothed by making the fine-grinding press pad 47 project in the Y-direction by the air actuator (while changing the amount of projection of the fine-grinding press pad 47 in the Y-direction as needed) while making the grinding belt 38 run and while making the belt grinding apparatus 30 (the work section belt 38X) move parallel to the surface 11S and the surface 12S of the door frame 10. In this process, similar to the bead removing step, grinding conditions including the running speed of the grinding belt 38 by the drive motor 32, the tension of the grinding belt 38 by the air swing actuator 35, and the pressure of the projecting rough-grinding press pad 46 by an air actuator are varied so that the takt time becomes constant.

In the above illustrated weld bead removing step and smoothing step, the inner sides of the butt-welding edge 11T and the butt-welding edge 12T of the door frame 10 are lifted to become closer to a flat surface using the partial floatation apparatus 62 shown in FIG. 5. Although the surface 11S and the surface 12S are exaggeratedly shown to be nonparallel to each other in FIGS. 6(B) and 6(C), the surface 11S and the surface 12S can be regarded as a sufficiently flat surface in practice. This smoothing step makes the trace of the weld bead 13 a flat surface which is smoothly connected to the surface 11S and the surface 12S around the trace of the weld bead 13. At this time, the grinding resistance created by the work section belt 38X can be detected from loads exerted on the drive motor 32, and accordingly, grinding conditions including the running speed of the grinding belt 38 by the drive motor 32, the tension of the grinding belt 38 by the air swing actuator 35, and the pressure of the projecting rough-grinding press pad 46 by an air actuator are determined so that the grinding resistance becomes an appropriate value and so that the grinding process is performed in a fixed period of time (takt time; e.g., seven seconds).

Figure 8:
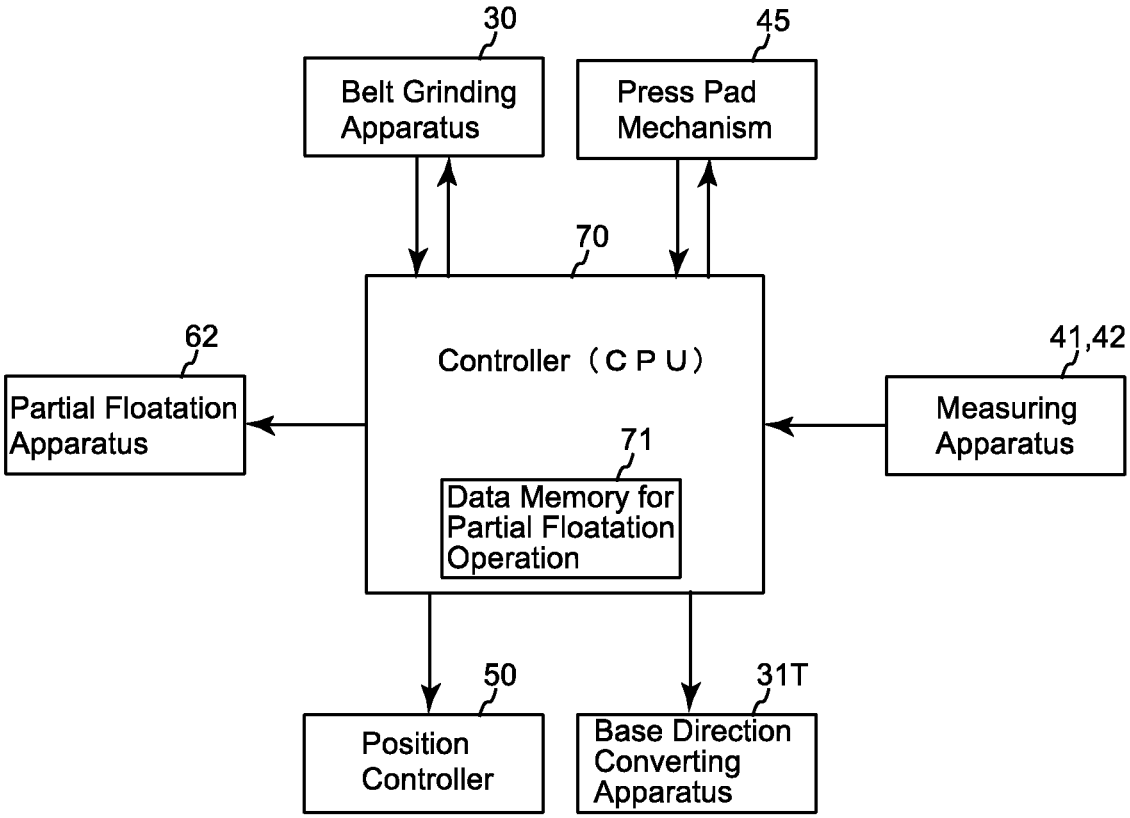
FIG. 8 is a block diagram of the apparatus for smoothing a welded area according to the present invention.

FIG. 8 is a block diagram of the apparatus for smoothing the above described welded area. A controller 70 controls the position controller 50 (the base direction (orientation) converting apparatus 31T), the belt grinding apparatus 30 and the press pad mechanism 45; upon the heights (Y-coordinates) of the surface 11S of the pillar member 11 and the surface 12S of the frame member 12 along the weld bead 13 being detected by the laser length-measuring apparatus 40 (the laser length-measuring devices 41 and 42) that is provided on the support base 31 of the belt grinding apparatus 30, data on the heights thus detected is input, and the belt grinding apparatus 30 and the press pad mechanism 45 are controlled based on the input signal. Additionally, a data memory 71 for a partial floatation operation, which supplies an operation signal to the partial floatation apparatus 62 in accordance with the shapes of the pillar member 11 and the frame member 12, is incorporated in the controller 70.

It is desirable that the partial floatation apparatus 62 be installed in the case where the two welded members are two members (the pillar member 11 and the frame member 12 in the present embodiment) whose surfaces to be ground are not flat surfaces (partly curved surfaces); however, the partial floatation apparatus 62 is unnecessary when surfaces of the two members which are to be ground are flat surfaces. Additionally, in the above illustrated embodiment, a more desirable grinding operation can be performed because the rough-grinding press pad 46 of the press pad mechanism 45 is used at the weld bead removing step and the fine-grinding press pad 47 of the press pad mechanism 45 is used at the smoothing step; however, both can also be performed using the same press pad. Conversely, it is possible for other types of press pads to be prepared and selectively used.

Figure 9:
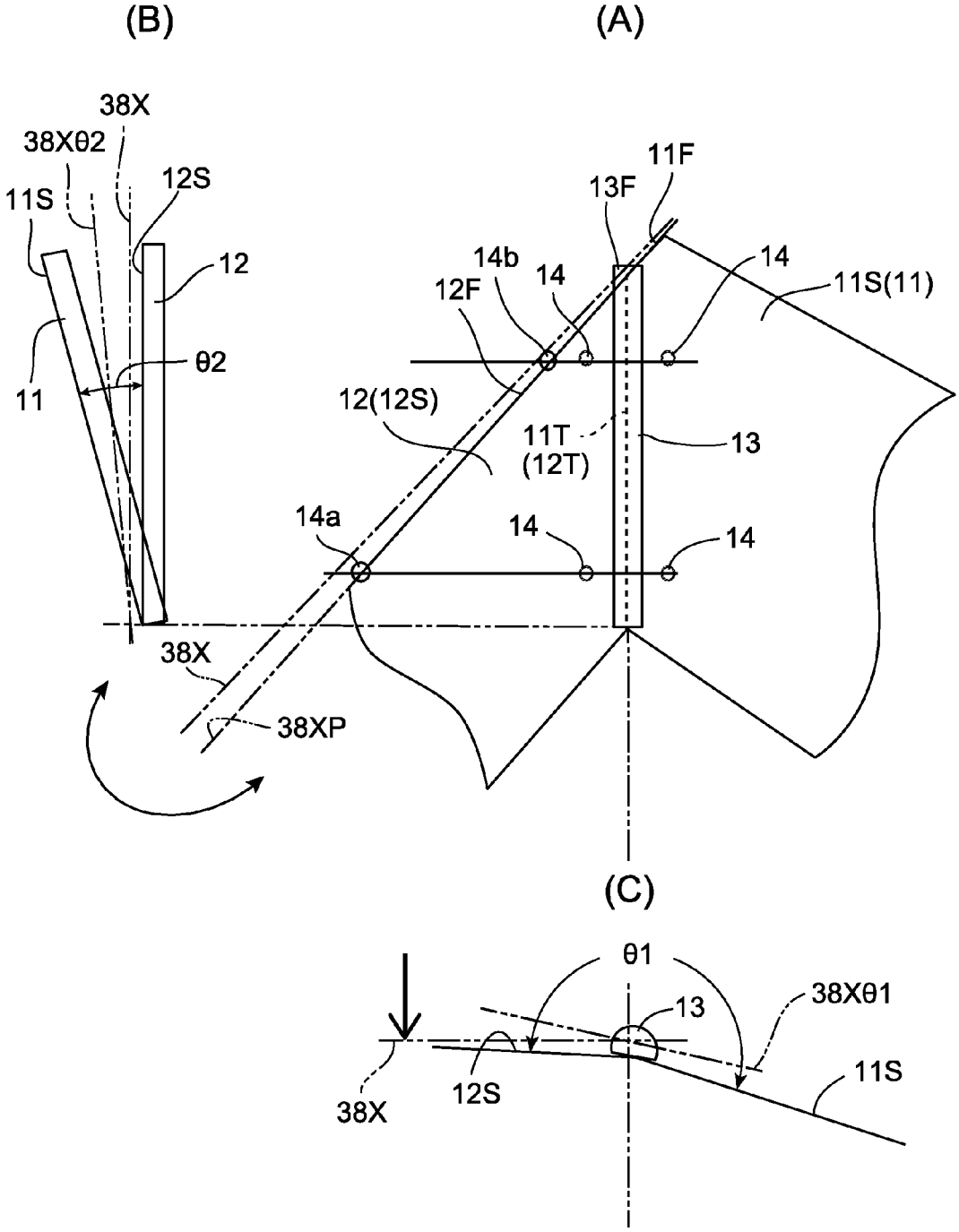
FIGS. 9(A), 9(B) and 9(C) are a plan view, a side elevational view and a front elevational view that show a second embodiment of the method of smoothing the welded area according to the present invention.
Figure 10:
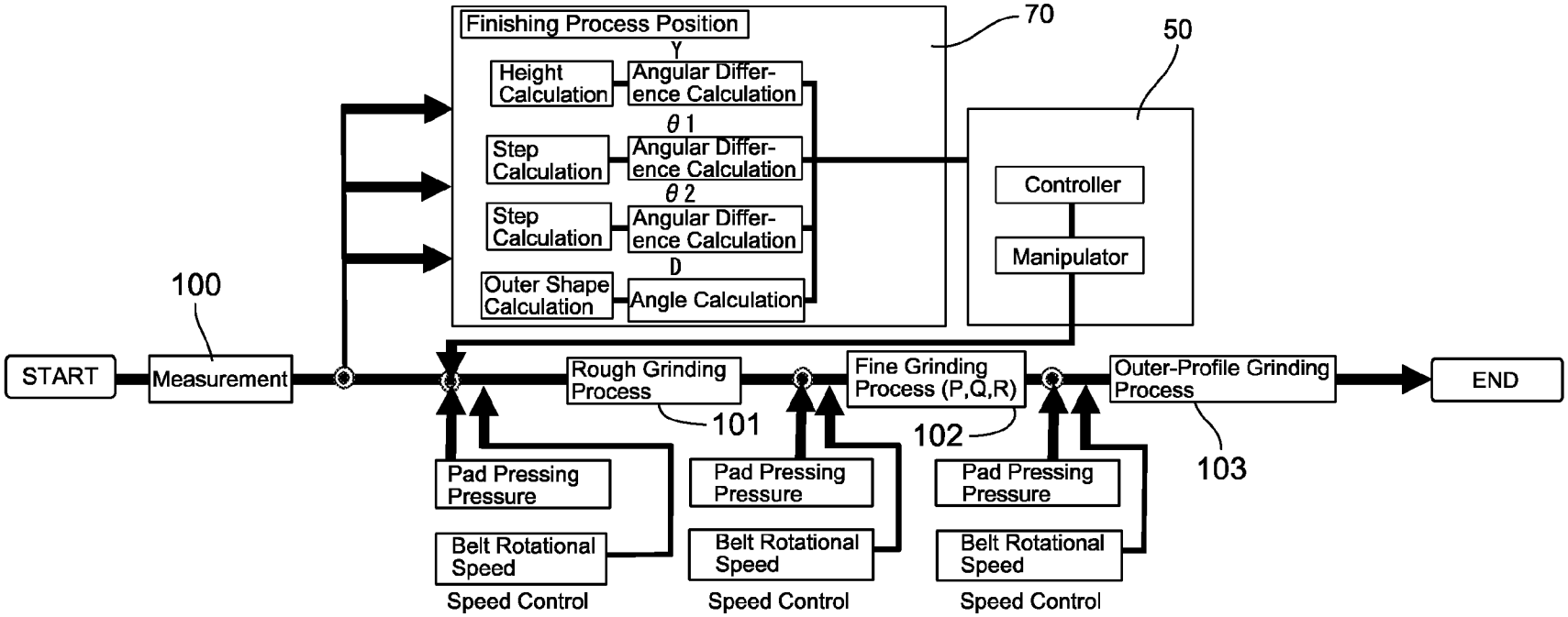
FIG. 10 is a control block diagram of the second embodiment.
Figure 11:
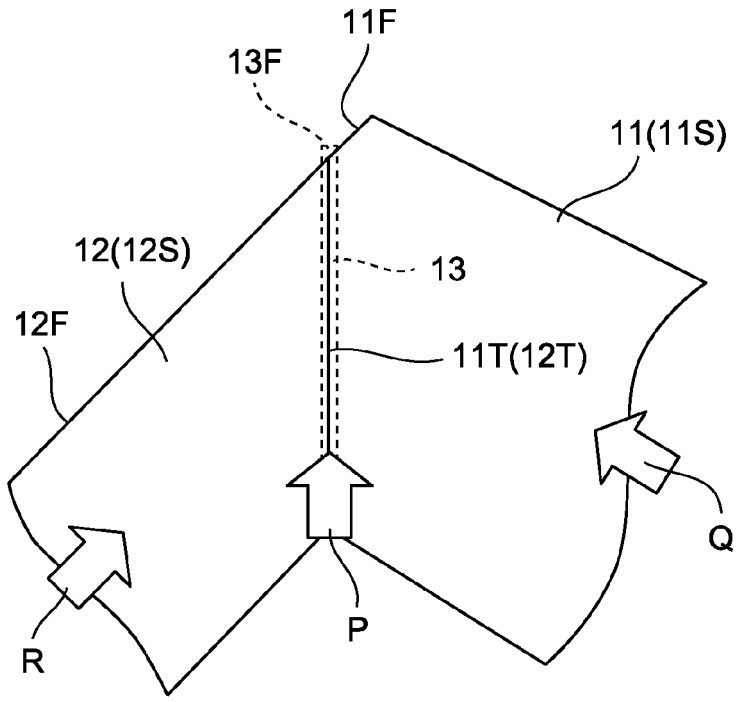
FIG. 11 is a plan view showing a third step of the welded area smoothing step (precision grinding process) of the second embodiment.

The above illustrated embodiment is an embodiment in which the weld bead 13 is removed by performing the above described weld bead removing (height reducing) step (rough grinding process) and the welded area smoothing step (fine grinding process) on the assumption that no step exists between the surface 11S of the pillar member 11 and the surface 12S of the frame member 12. However, in an actual welding operation, the occurrence of a small step (difference in level) between the surface 11S and the surface 12S is inevitable. FIG. 9 illustrates the angular difference (inclination, θ1) (FIG. 9C) in a direction orthogonal to the weld bead 13 between the surface 11S of the pillar member 11 and the surface 12S of the frame member 12 and the angular difference (inclination, θ2) (FIG. 9B) in a direction of extension of the weld bead 13 between the surface 11S of the pillar member 11 and the surface 12S of the frame member 12. The difference in actual height between the surface 11S and the surface 12S is in the order of micrometers, thus being exaggeratedly shown in the drawings. In FIG. 9, the positions of the heights of the positions of the butt-welding edge 11T of the pillar member 11 and the butt-welding edge 12T of the frame member 12 are made to coincide with each other on the inner peripheral side (on the window opening side). A second embodiment according to the present invention shown in FIGS. 9 through 11 is different from the first embodiment mainly in regard to points (1), (2) and (3) which will be discussed hereinafter.

(1) The weld bead 13 is removed by the above-mentioned rough grinding process (and the above-mentioned fine grinding process) while taking into consideration the fact that an angular difference (inclination, θ1) occurs in a direction orthogonal to the weld bead 13 between the surface 11S of the pillar member 11 and the surface 12S of the frame member 12, and the angular difference (inclination, θ2) occurs in a direction of extension of the weld bead 13 between the surface 11S of the pillar member 11 and the surface 12S of the frame member 12 (the surface 11S and the surface 12S do not exactly lie in a single plane). In addition, the fine grinding process is performed a plurality of times with the work section belt 38X (the fine-grinding press pad 47) in different movement directions.

(2) An upper edge (plane portion) 11F which is flush with an upper edge (plane portion) 12F of the frame member 12 is formed at the upper end of the pillar member 11, and a projecting bead 13F which projects from the upper edges 12F and 11F is also removed.

(3) After the weld bead 13 and the projecting bead 13F are removed, a polishing process (joint removing process) is performed.

In the present embodiment, the belt grinding apparatus 30 is made to swing about the shaft 55 or (and) the rotational shaft 57X of the position controller 50, while taking consideration of the angular differences θ1 and θ2, so that the difference between the angle between the surface 11S and the work section belt 38X (the end pressing plane of the rough-grinding press pad 46 or the fine-grinding press pad 47) and the angle between the surface 12S and the work section belt 38X (the end pressing plane of the rough-grinding press pad 46 or the fine-grinding press pad 47) is reduced, and the above-mentioned rough grinding process (and the above-mentioned fine-grinding process) is performed in this swinging state. The direction of the work section belt 38X after adjustment that is defined in consideration of the angular difference θ1 is designated by 38X θ1 in FIG. 9(C), and the direction of the work section belt 38X after adjustment that is defined in consideration of the angular difference θ2 is designated by 38X θ2 in FIG. 9(B).

In this embodiment, after the work section belt 38X (the rough-grinding press pad 46) is made to tilt by 38X θ1 and 38X θ2 relative to the surface 11S and the surface 12S as shown in FIGS. 9(B) and 9(C), the amount of projection of the rough-grinding press pad 46 is determined using information on the height measuring points 14 on the surface 11S and the surface 12S, and the rough grinding process is performed. In the rough grinding process, similar to the first embodiment, the amount of projection of the rough-grinding press pad 46 is set so that the work section belt 38X reaches the lowest measuring point (surface) among the four height measuring points 14.

The fine grinding process that is performed with the work section belt 38X and the fine-grinding press pad 47 is performed in three steps as shown in FIG. 11. The first fine grinding step (P) is a process performed by moving the work section belt 38X and the fine-grinding press pad 47 in a direction P along the (removed) weld bead 13 on the surface 11S and the surface 12S, the second fine grinding step (Q) is a process performed by moving the work section belt 38X and the fine-grinding press pad 47 in a direction Q along the lengthwise direction of the pillar member 11, and the third fine grinding step (R) is a process performed by moving the work section belt 38X and the fine-grinding press pad 47 in a direction R along the lengthwise direction of the frame member 12. As seen above, the surface 11S and the surface 12S can further be smoothed by performing the fine grinding process in three steps.

The work section belt 38X (and the fine-grinding press pad 47) is held at an angle in consideration of both the angle 38X θ1 and the angle 38X θ2 at the first fine grinding step (P) and put into action, is held at the angle 38X θ1 and put into action at the second fine grinding step (Q) and is held at the angle 38X θ2 and put into action at the third fine grinding step (R).

In the embodiment shown in FIG. 9, an outer-profile grinding process for removing the projecting bead 13F of the weld bead 13 is additionally performed. In the outer-profile grinding process, first of all, in the measuring step performed at the four height measuring points 14, information on the planar positions in FIG. 9(A) of a measuring edge 14*a* and a measuring edge 14*b* on the upper edge 12F is obtained using a linear laser length-measuring apparatus, as a laser length-measuring apparatus, with which height information can be obtained along a linear measuring line. Based on this planar position information, the angle (direction) D of the work section belt 38X (and the rough-grinding press pad 46 or the fine-grinding press pad 47) is set by the position controller 50 to be parallel to a line (plane) which connects the measuring edges 14*a* and 14*b*. In FIG. 9(A), the direction of the work section belt 38X after adjustment that is defined in consideration of the angle D is designated by XP. Performing a belt grinding operation over the upper edge 12F and the upper edge 11F with the direction of the work section belt 38X set in this manner makes it possible to remove the projecting bead 13F in parallel with the upper edge 12F and the upper edge 11F.

FIG. 10 is a control block diagram of the second embodiment. At a measuring step 100, the heights of the surface 11S and the surface 12S at the four height measuring points 14 surrounding the weld bead 13 (and the planar positions of the measuring edge 14*a* and the measuring edge 14*b*) are measured (detected), and a height calculation Y, an angular difference calculation θ1 and θ2, and an angle calculation D are performed. Based on these calculations, the direction of the work section belt 38X of the belt grinding apparatus 30 (and the rough-grinding press pad 46 or the fine-grinding press pad 47) is set, and a rough grinding process 101, a fine grinding process (P, Q, R) 102 and an outer-profile grinding process 103 are performed. The pad pressing pressure and the belt rotational speed at each process can be freely (individually) controlled. The three-step processes P, Q and R, in the fine grinding process can be performed on the same condition or different conditions.

Figure 13:
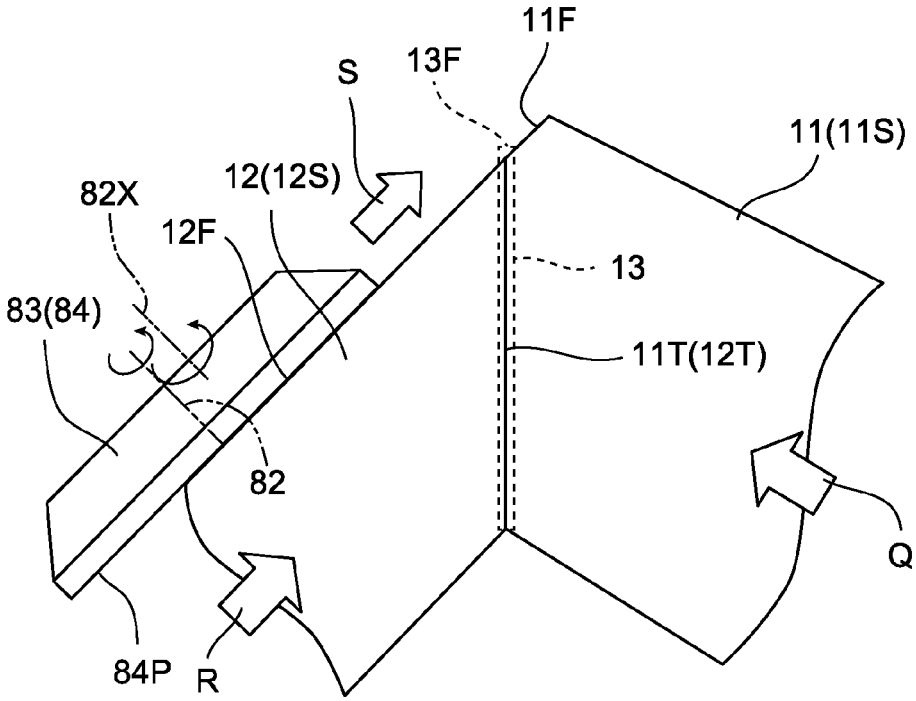
FIG. 13 is a plan view showing three steps of the polishing process.
Figure 12:
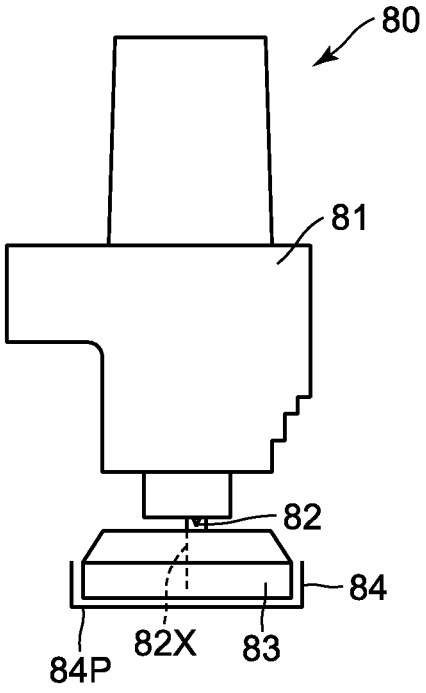
FIG. 12 is a conceptual diagram showing an example of a polisher used in a polishing process.

FIGS. 12 through 14 show a polishing process (joint removing process) which is performed after the above described belt grinding process, which is performed using the grinding belt 38 (the work section belt 38X). FIG. 12 is a conceptual diagram of a polisher 80. The polisher 80 in this embodiment is a double-action type which performs rotational motion and eccentric rotational motion and is provided with a polisher body 81, an eccentric rotary shaft 82 which projects from the polisher body 81, a polishing rotor 83 which is mounted to the end of the eccentric rotary shaft 82, and a polishing paper 84 which is mounted (dismounted and replaced) to the polishing rotor 83. The eccentric rotary shaft 82 eccentrically rotates about a rotational center 82X while rotating on the axis of the eccentric rotary shaft 82. A polishing plane presented by the polishing rotor 83 (the polishing paper 84) is designated by 84P. As a double-action type of polisher, a type which performs rotational motion and vibrating motion (axially reciprocating motion) is known, or a single-action type which performs only rotational motion is also known; either type can be selected and used.

Since the polisher 80 is supported, in a similar manner to that of the belt grinding apparatus 30, by another support head plate 58 of the position controller 50, the polisher 80 can be oriented at any given direction. The simplest method of polishing the surface 11S and the surface 12S using the polisher 80 is that in which a process of grinding the surfaces of the butt-welding edge 11T and the butt-welding edge 12T is carried out with the rotational plane of the polishing rotor 83 (the polishing paper 84) set to be substantially parallel to the surface 11S and the surface 12S. As shown in FIG. 13, this polishing desirably includes a first joint removing process in which the polishing rotor 83 (the polishing paper 84) is moved on the surface 11S and the surface 12S in a Q-direction along the lengthwise direction of the pillar member 11, a second joint removing process in which the polishing rotor 83 (the polishing paper 84) is moved on the surface 11S and the surface 12S in an R-direction along the lengthwise direction of the frame member 12, and a third joint removing process in which the polishing rotor 83 (the polishing paper 84) is moved on the surface 11S and the surface 12S linearly in an S-direction along the upper edge 12F and the upper edge 11F after the polishing plane 84P of the polishing rotor 83 (the polishing paper 84) is set parallel to the upper end 12F and the upper end 11F from which the projecting bead 13*f* has been removed. It is desirable for the polishing diameter of the polishing rotor 83 (the polishing paper 84) to be made sufficiently greater than the widths of the pillar member 11 and the frame member 12.

As described above, the angular difference (θ1) in a direction orthogonal to the butt-welding edge 11T and the butt-welding edge 12T (the weld bead 13) exists between the surface 11S and the surface 12S and the angular difference (θ2) in a direction of extension of the weld bead 13 exists between the surface 11S and the surface 12S. In the joint removing process and the second joint removing process of the controller 70, similar to the above described grinding process, the direction of the polishing plane 84P of the polishing rotor 83 (polishing paper 84) can be controlled based on information on the angular differences θ1 and θ2.

FIG. 14 is a conceptual diagram showing a corner rounding process which can be optionally performed. An edge E on the vehicle exterior side of the upper edge 11F and 12*f* is rounded by applying a swing motion of the polishing rotor 83 (the polishing paper 84) of the polisher 80 about the edge E while rotating the polishing rotor 83 (the polishing paper 84) with the polishing rotor 83 (the polishing paper 84) brought into contact with the edge E, and as necessary, by moving the polishing rotor 83 (the polishing paper 84) in the lengthwise (extension) direction of the upper edge 11F and the upper edge 12F (in a direction perpendicular to the sheet).

The above described illustrates the pillar member 11 and the frame member 12 of the door frame 10 as two welded members, and the present invention has been applied to a welded corner between the pillar member 11 and the frame member 12; however, the present invention can also be applied to other two welded members.

INDUSTRIAL APPLICABILITY

The method and apparatus for smoothing welded members according to the present invention are applicable to a vehicle door frame and are also widely applicable to techniques of smoothing a welded area of two welded members.

REFERENCE SIGN LIST

10 Door frame
11 Pillar member (two welded members)
12 Frame member (two welded members)
11T 12T Butt-welding edge
11S 12S Surface
11F and 12F Upper edge (plane portion)
13 Weld bead
13F Projecting bead
14 Height measuring point
20 Smoothing mechanism
30 Belt grinding apparatus
31 Support base
32 Drive motor
33 Drive pulley
34 Guide pulley
35 Air swing actuator
36 Tension pulley
38 Grinding belt
38X Work section belt
40 Laser length-measuring unit (measuring apparatus)
41 42 Laser length-measuring device
45 Press pad mechanism
46 Press pad (for use in rough grinding)
47 Press pad (for use in fine grinding)
43 Rotational actuator
50 Position controller
51 Body base
52 Rotatable base
53 55 Shaft
54 First arm
56 Second arm
57 Rotatable base
57X Rotational shaft
58 Support head plate
60 Jig
61 Work accommodating portion
62 Partial floatation apparatus
63 Shaft
64 Lifting crank
64*a* Lifting arm
64*b* Drive arm
65 Air actuator
70 Controller
80 Polisher
81 Polisher body
82 Eccentric rotary shaft
83 Polishing rotor
84 Polishing paper
100 Measuring step
101 Rough grinding process
102 Fine grinding process
103 Outer-profile grinding process

The invention claimed is:

1. A welded area smoothing method for removing and smoothing a weld bead of two welded members, comprising:

a step of preparing a belt grinding apparatus, which includes an endless grinding belt and a press pad that presses said grinding belt against said welded area;

a measuring step for detecting positions of heights of surfaces of said two welded members along said weld bead;

a bead removing step for reducing a height of said weld bead by pressing said grinding belt against said welded area via said press pad while running said grinding belt using information on said positions of said heights of said surfaces of said two welded members that are detected in said measuring step; and a smoothing step for smoothing said welded area by pressing said grinding belt against said welded area via said press pad while running said grinding belt and moving said grinding belt along said surfaces of said two welded members.

2. The welded area smoothing method according to claim 1, wherein information on heights of a plurality of points along both sides of said weld bead is obtained in said measuring step.

3. The welded area smoothing method according to claim 1, further comprising:

a step of detecting an angular difference between said surfaces of said two welded members in a direction orthogonal to said weld bead and in a direction along said weld bead; and a step of adjusting angles of said grinding belt and said press pad relative to said surfaces of said two welded members based on said angular difference that is detected in said angular difference detecting step.

4. The welded area smoothing method according to claim 1, wherein said two welded members each comprise a plane portion which extends leftward and rightward from an end of said weld bead in a direction of extension thereof, and wherein said method further comprises a step of grinding and removing a projecting weld bead which projects from said plane portion using said grinding belt and said press pad.

5. The welded area smoothing method according to claim 1, wherein said two welded members are uneven members, one end part of which is lower in a direction of formation of said weld bead, and wherein said bead removing step and said smoothing step are performed by lifting a lower part of said two welded members.

6. The welded area smoothing method according to claim 1, wherein a hardness of said press pad used in said bead removing step is greater than a hardness of said press pad used in said smoothing step.

7. The welded area smoothing method according to claim 1, wherein a width of said grinding belt and a planar size of said press pad are each set to a size to cover the length of said weld bead.

8. The welded area smoothing method according to claim 1, wherein, in said bead removing step, at least one of the following grinding conditions is determined so that said weld bead is removed within a fixed time period: a running speed and a tension of said grinding belt, and a projecting amount and a projecting force of said press pad.

9. The welded area smoothing method according to claim 1, further comprising:

performing a joint removing process step using a polisher on surfaces of said two welded members, from which said weld bead has been removed, after said weld bead removing step and said smoothing step has been performed using said grinding belt.

10. The welded area smoothing method according to claim 9, further comprising:

a step of detecting an angular difference between said surfaces of said two welded members in a direction orthogonal to said weld bead and in a direction along said weld bead; and a step of adjusting an angle of said polisher based on said angular difference that is detected in said angular difference detecting step.

11. The welded area smoothing method according to claim 1, wherein said two welded members comprise a pillar member and a frame member of a door frame.

12. A welded area smoothing apparatus for removing and smoothing a weld bead of two welded members, comprising:

a belt grinding apparatus which includes an endless grinding belt that is driven to run and a press pad that presses said grinding belt against said welded area;

a jig for setting said two welded members which include said weld bead;

a measuring apparatus which measures positions of heights of surfaces of said two welded members, which are set by said jig, along said weld bead;

a position controller which moves said belt grinding apparatus relative to said jig; and a controller which controls said belt grinding apparatus, said measuring apparatus and said position controller, wherein said controller reduces a height of said weld bead by pressing said grinding belt against said welded area via said press pad while running said grinding belt using information on said positions of said heights of said surfaces of said two welded members that are detected by said measuring apparatus, and subsequently, said controller smoothes said welded area by pressing said grinding belt against said welded area via said press pad while running said grinding belt and moving said grinding belt along said surfaces of said two welded members.

13. The welded area smoothing apparatus according to claim 12, wherein said measuring apparatus further detects an angular difference between said surfaces of said two welded members in a direction orthogonal to said weld bead and in a direction along said weld bead, and wherein said controller adjusts angles of said grinding belt and said press pad relative to said surfaces of said two welded members based on said angular difference.

14. The welded area smoothing apparatus according to claim 12, wherein said two welded members comprise a plane portion which extends leftward and rightward from an end of said weld bead in a direction of extension thereof, and wherein said controller grinds and removes a projecting weld bead which projects from said plane portion using said grinding belt and said press pad.

15. The welded area smoothing apparatus according to claim 12, wherein said two welded members are an uneven member, one end of which in a direction of formation of said weld bead is low, and wherein said jig comprises a partial floatation apparatus which lifts a lower part of said two welded members.

16. The welded area smoothing apparatus according to claim 12, wherein said belt grinding apparatus comprises a press pad mechanism which switches said press pad to be used for another press pad during said removing and smoothing of said weld bead.

17. The welded area smoothing apparatus according to claim 12, further comprising, in addition to said belt grinding apparatus, a polisher used to perform a joint removing process on surfaces of said two welded members from which said weld bead is removed.

18. The welded area smoothing apparatus according to claim 17, wherein said polisher can adjust an angle thereof based on an angular difference between said surfaces of said two welded members in a direction orthogonal to said weld bead and in a direction along said weld bead.

* * * * *